US005340940A

United States Patent [19]

Iizuka et al.

[11] Patent Number: 5,340,940

[45] Date of Patent: Aug. 23, 1994

[54] MUSICAL TONE GENERATION APPARATUS CAPABLE OF WRITING/READING PARAMETERS AT HIGH SPEED

[75] Inventors: Akira Iizuka; Keiji Kawakami, both of Hamamatsu, Japan

[73] Assignee: Yamaha Corporation, Hamamatsu, Japan

[21] Appl. No.: 673,129

[22] Filed: Mar. 20, 1991

[30] Foreign Application Priority Data

Mar. 20, 1990 [JP] Japan ..... 2-70508
Mar. 20, 1990 [JP] Japan ..... 2-70509

[51] Int. Cl.[5] ..... G10H 7/00; G10H 1/06

[52] U.S. Cl. ..... 84/622; 84/603; 84/618

[58] Field of Search ..... 84/600–604, 84/615, 618, 622, 653, 656

[56] References Cited

U.S. PATENT DOCUMENTS 4,365,532 12/1982 Nakada et al. ..... 84/615
4,612,839 9/1986 Sunada .
4,703,680 11/1987 Wachi et al. ..... 84/615
4,706,538 11/1987 Yoshida ..... 84/656
4,858,508 8/1989 Shibukawa ..... 84/602
4,872,385 10/1989 Oguri et al. .
4,893,538 1/1990 Masaki et al. ..... 84/605
4,984,497 1/1991 Inagaki et al. ..... 84/602
5,007,323 4/1991 Usami ..... 84/607
5,095,800 3/1992 Matsuda ..... 84/618
5,107,747 4/1992 Saito ..... 84/655

FOREIGN PATENT DOCUMENTS 0126975 5/1984 European Pat. Off. .
0235768 9/1987 European Pat. Off. .
3413993 10/1985 Fed. Rep. of Germany .

*Primary Examiner*—William M. Shoop, Jr.
*Assistant Examiner*—Jeffrey W. Donels
*Attorney, Agent, or Firm*—Graham & James

[57] ABSTRACT

A musical tone generation apparatus is provided with a plurality of tone generation channels, a first memory for storing musical tone parameter including tone color specifying parameter, i.e., tone color name or number of tone color, in units of the tone generation channels, and a second memory for storing tone color parameter data. When tone color change is designated, the first parameter memory outputs tone color specifying parameter to the second parameter memory. In response to this, the second memory outputs the changed tone color parameter data to the tone generation channels to thereby generate tone having new tone color. As a result, tone color change is easily performed.

6 Claims, 6 Drawing Sheets $$\Phi_1 = (\overline{\Phi_{S1} \text{ or } \Phi_{S3}})$$
$$= (\Phi_{S2} \text{or } \Phi_{S4})$$

MUSICAL TONE GENERATION APPARATUS CAPABLE OF WRITING/READING PARAMETERS AT HIGH SPEED

BACKGROUND OF THE INVENTION

1. Field of the Invention

The present invention relates to a musical tone generation apparatus applied to, e.g., an electronic musical instrument and, more particularly, to a musical tone generation apparatus which has hierarchical parameter memory devices for storing various parameters for characterizing musical tones to be generated, can decrease the number of rewrite times of parameters, and can rewrite parameters at high speed.

Furthermore, the present invention relates to a musical tone generation apparatus which can write data in an arbitrary channel using a random-access memory device such as a RAM regardless of a channel counter, and to a musical tone generation apparatus which uses parallel random-access memory devices to alternatively read out data from these memory devices.

2. Description of the Prior Art

In a conventional musical tone generation apparatus, various parameter values are written in a plurality of registers (parameter memory means) for storing parameters for each channel, and musical tones are generated in tone colors according to these parameters. For example, in an FM tone generator, when a musical tone is to be generated in a predetermined musical tone generation channel in a desired tone color, parameter values (e.g., tone color data) must be written in registers of the predetermined channel so as to give musical tone generation parameters such as a frequency number (F number) to a carrier operator or a modulator operator in a musical tone forming means.

In a conventional musical tone generation apparatus having the parameter memory means, a plurality of registers for storing parameters such as tone color data are prepared in one channel.

For this reason, when a tone color in one channel is to be switched, a set of parameters (tone color data) stored in the channel must be entirely rewritten. Therefore, rewrite processing exerts a heavy load on a central processing unit (CPU), and a time required for switching a tone color is undesirably prolonged.

The conventional musical tone generation apparatus employs a system for detecting a coincidence between a channel counter, and a write channel register, and generating a write signal to perform write access.

For this reason, a time corresponding to one cycle of channel counter is required at maximum for single write access of the register. For example, when the CPU successively writes parameter data in the registers, it must wait for a time corresponding to one cycle of channel counter after instruction write access of one data, and then must write the next data, thus posing a problem as to time.

The present invention has as its object to provide a musical tone generation apparatus used in, e.g., an electronic musical instrument, which apparatus can reduce a load on a CPU, and can change various parameters such as a tone color within a short period of time.

It is another object of the present invention to provide a musical-tone generation apparatus which can realize high-speed read/write access of parameters.

SUMMARY OF THE INVENTION

A musical tone generation apparatus having tone generation channels according to the present invention comprises first parameter memory means for storing parameters for each tone generation channel, second parameter memory means for storing parameters for specifying tone colors, which parameters can be read out according to the parameter stored in the first parameter memory means, and musical tone forming means for receiving the parameters for specifying the tone color read out from the second parameter memory means, and forming a musical tone according to the parameters.

With this arrangement, a parameter memory means has a hierarchical structure of the first and second parameter memory means, and the second parameter memory means can be accessed on the basis of specific parameter data stored in the first parameter memory means. Therefore, a parameter stored in the second parameter memory means can be easily changed and read out by rewriting the specific parameter data.

A musical tone generation apparatus having time divisional tone generation channels according to the present invention comprises random-access memory means capable of storing parameters for characterizing musical tones to be generated at arbitrary address positions, channel timing generation means for generating generation timing of the time divisional tone generation channels, write means for writing a parameter in the random-access memory means, and read means for sequentially reading out the parameters from the random-access memory means in accordance with the generation timing.

The random-access memory means inevitably has a delay time in its operation to some extent, and when a parameter is read out from the random-access memory means in correspondence with a high-speed time-divisional musical tone synthesis arithmetic operation of a sound source circuit, a read operation cannot often be executed in time. Therefore, according to the present invention, in order to realize a high-speed read operation, the musical tone generation apparatus comprises third and fourth parameter memory means for storing parameters for characterizing musical tones to be generated, means for instructing the third and fourth parameter memory means to perform write and read operations of parameter data at the same address, output means for receiving a signal which is switched between "0" and "1" at a high speed, and switching parameter data output from the third and fourth parameter memory means upon switching of the signal, and musical tone forming means for receiving the parameter data outputted from the output means, and forming a musical tone on the basis of designation of the parameter data.

With this arrangement, since the parameter memory means comprises random-access memory means, data can be written in an arbitrary channel regardless of a channel counter. A read operation by the channel counter, and a write operation by designating a channel may be time-divisionally performed.

If RAMs are arranged in parallel with each other and are alternately subjected to read access, parameters can be read out at a sufficient speed by using RAMs which have a lower access speed than that of a shift register.

DETAILED DESCRIPTION OF THE PREFERRED EMBODIMENT

An embodiment of the present invention will be described below with reference to the accompanying drawings.

Figure 1:
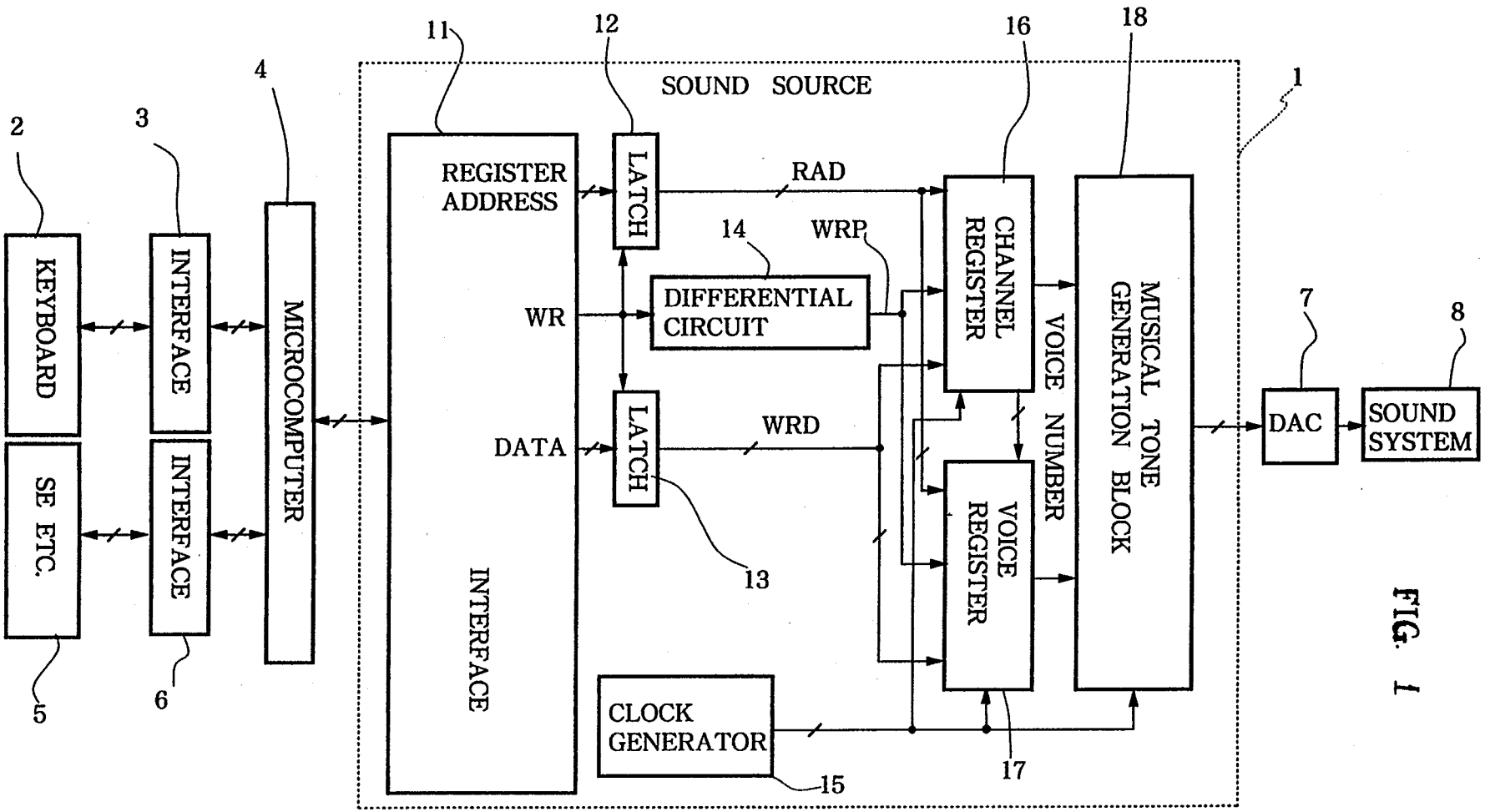
FIG. 1 is a schematic block diagram showing an arrangement of an electronic musical instrument to which a musical tone generation apparatus according to an embodiment of the present invention applied.

FIG. 1 is a schematic block diagram showing an arrangement of an electronic keyboard instrument to which a musical tone generation apparatus according to an embodiment of the present invention is applied.

In FIG. 1, key ON data generated by a key ON event on a keyboard 2 is inputted to a microcomputer 4 via an interface 3, and is subjected to predetermined processing. The processed data is then input to an interface 11 of a musical tone generation apparatus (sound source) 1. Similarly, operation data generated upon operation of an operation member 5 such as various panel switches is inputted to the microcomputer 4 via an interface 6, and is subjected to predetermined processing. The processed data is then input to the interface 11 of the sound source 1.

The sound source 1 comprises the interface 11, latches 12 and 13, a differential circuit 14, a clock generator 15, a channel register section (first parameter memory means) 16, a voice register section (second parameter memory means) 17, and a musical tone generation block (musical tone forming means) 18. Each of the channel register section 16 and the voice register section 17 has a plurality of registers. Each register has a plurality of storage areas (storage positions).

Address and data portions of parameters such as tone color data are separately inputted from the microcomputer 4 to the interface 11.

The address indicates a storage position of data in one of registers in the channel or voice register section 16 or 17. This address is data for specifying a channel and a slot, as will be described later. The address, i.e., channel & slot specifying data, is stored as data in the latch 13 at an output timing of a write signal WR, and is then transferred to the channel or voice register section 16 or 17.

Immediately after the channel & slot specifying data corresponding to an intra-register address is transferred, parameter data to be actually written in a register is transferred. The parameter data is stored in the latch 13 in response to a leading edge of the output write signal WR. A register address for specifying one of a plurality of registers is latched by the latch 12 in response to the leading edge of the output write signal WR. The latched register address RAD is inputted from the latch 12 to the channel or voice register section 16 or 17. The parameter data WRD stored in the latch 13 is inputted to the channel or voice register section 16 or 17, and is stored at a designated storage position of a designated register in the channel or voice register section 16 or 17 at an output timing of a write signal pulse WRP.

The write signal WR is outputted to the register sections as the write signal pulse WRP representing a proper timing via the differential circuit 14. More specifically, the write signal WR is inputted to the differential circuit 14. The differential circuit 14 generates the write signal pulse WRP at a proper timing on the basis of the write signal WR, and outputs it to the register sections.

The clock generator 15 outputs clock signals for defining write and read timings of registers. More specifically, the clock generator 15 generates pulse signals $\Phi_0$ to $\Phi_6$, and $\Phi_{S1}$ to $\Phi_{S4}$ shown in FIG. 6. The signals $\Phi_0$ to $\Phi_6$ correspond to values of respective digits obtained when 7-bit data having $\Phi_0$ as a digit of $2^0$ bit, $\Phi_1$ as a digit of $2^1$ bit, $\Phi_2$ as a digit of $2^2$ bit, . . . , $\Phi_6$ as a digit of $2^6$ bit is sequentially counted up. Of these pulse signals, the pulse signals $\Phi_0$ to $\Phi_6$ are used in read access and write access of the registers.

The apparatus of this embodiment has 16 time-divisional tone generation channels, and each channel is constituted of four time slots for four operators. In order to write a parameter while specifying an operator, a channel and an operator must be specified. In the apparatus of this embodiment, the signals $\Phi_6$ to $\Phi_3$ as upper 4 bits are used as a channel counter for specifying a channel, and the signals $\Phi_2$ and $\Phi_1$ as lower 2 bits are used as a slot counter for specifying an operator. Furthermore, the clock generator 15 outputs the slot signals $\Phi_{S1}$ to $\Phi_{S4}$ representing timings of the corresponding slots.

Referring again to FIG. 1, the channel register section 16 comprises a plurality of registers for storing parameter data for each channel. Parameters to be stored in the registers in units of channels include, e.g., frequency number (F number) data, initial phase data, depth data off a low-frequency oscillator LFO for adding a vibrato effect to a musical tone signal, touch EG (envelope generator) data for interpolating some detection values of after-touch data to obtain a smooth after-touch effect, attack rate data and peak level data which are given in each channel to obtain an initial-touch effect, and the like. Furthermore, the channel register section 16 stores voice number data for specifying one voice stored in the voice register section 17. Note that "voice" means a concept representing one tone color. One voice comprises a set of tone color control parameters stored in the voice register section 17. A plurality of voices are set in advance in the voice register section 17. Each voice represents one tone color, and is specified by a voice number. The channel register section 16 stores voice numbers for the respective channels. A musical tone generated in a given channel is produced in a voice (tone color) specified by the voice number for the given channel.

The voice register section 17 comprises a plurality of registers for storing parameter data (a set of tone color parameters). The parameter data to be stored in the voice register include data for instructing an algorithm of a musical tone synthesis arithmetic operation for determining a tone color of each voice, level and rate data of an envelope generator (EG) of each operator, data for the low-frequency oscillator (LFO), attack pitch data, and the like. In this embodiment, the channel register section 16 can store parameter data for sixteen channels, and the voice register section 17 can store parameter data for eight tone colors for storing tone colors determining parameter data.

Parameter data (tone color data) in the voice register section 17, which data is designated by a voice number stored in the channel register section 16, is transferred to the musical tone generation block 18. A musical-tone signal (digital value) outputted from the musical tone generation block 18 is inputted to a sound system 8 via a D/A (digital-to-analog) converter 7, and is produced as a musical tone.

Figure 2:
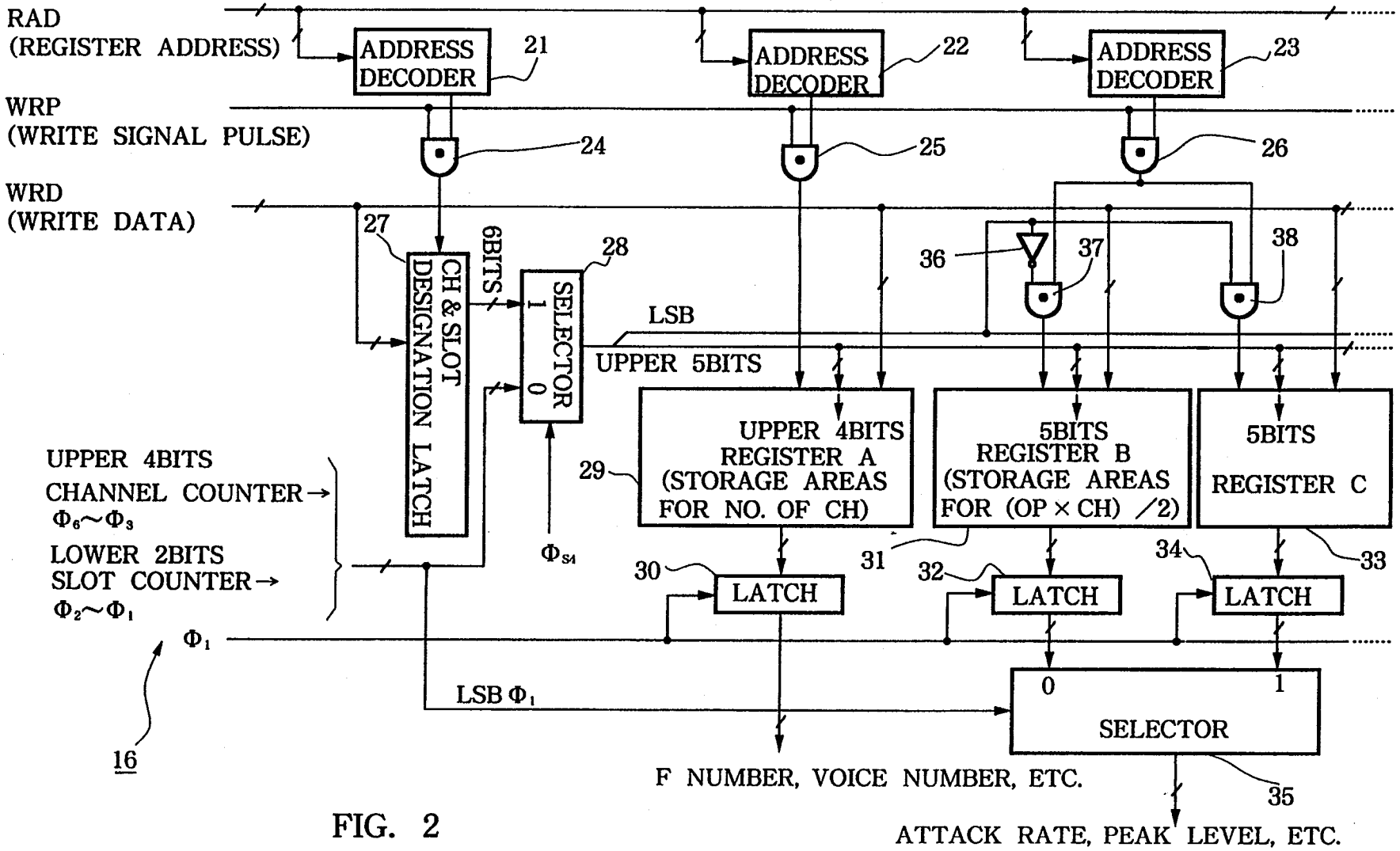
FIG. 2 is a detailed block diagram of a channel register section of the electronic musical instrument of this embodiment.
Figure 3:
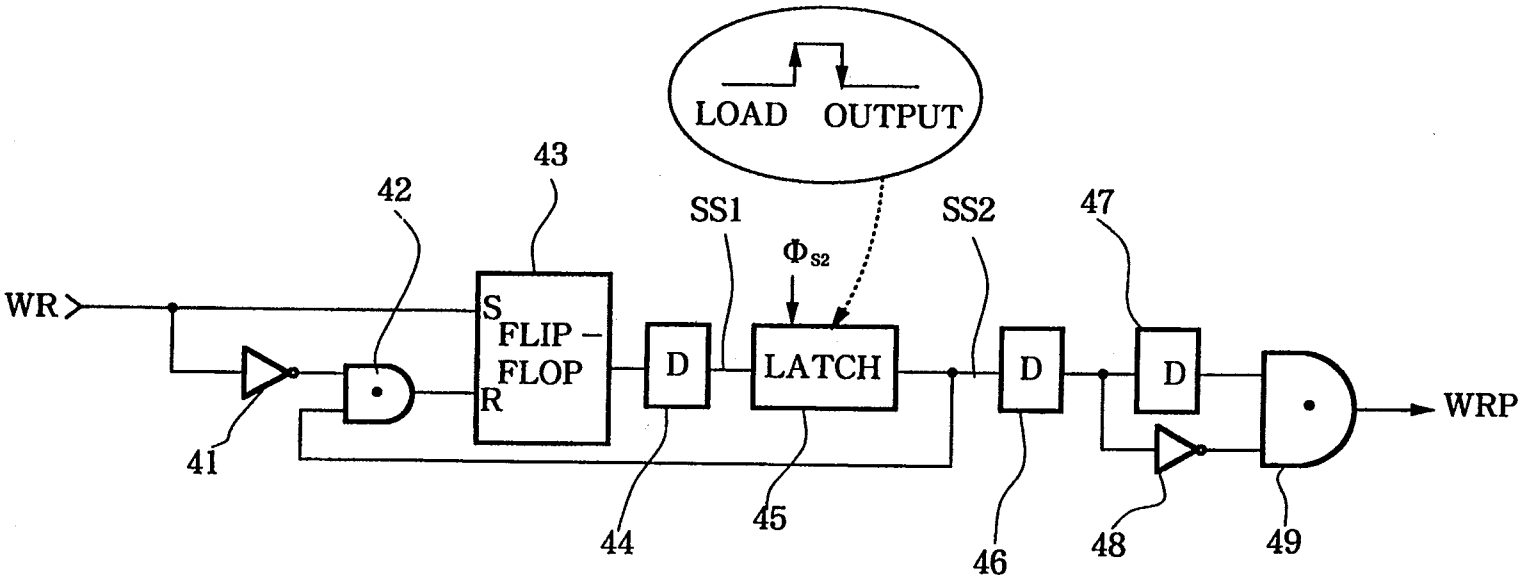
FIG. 3 is a detailed block diagram of a differential circuit of this electronic musical instrument.
Figure 5:
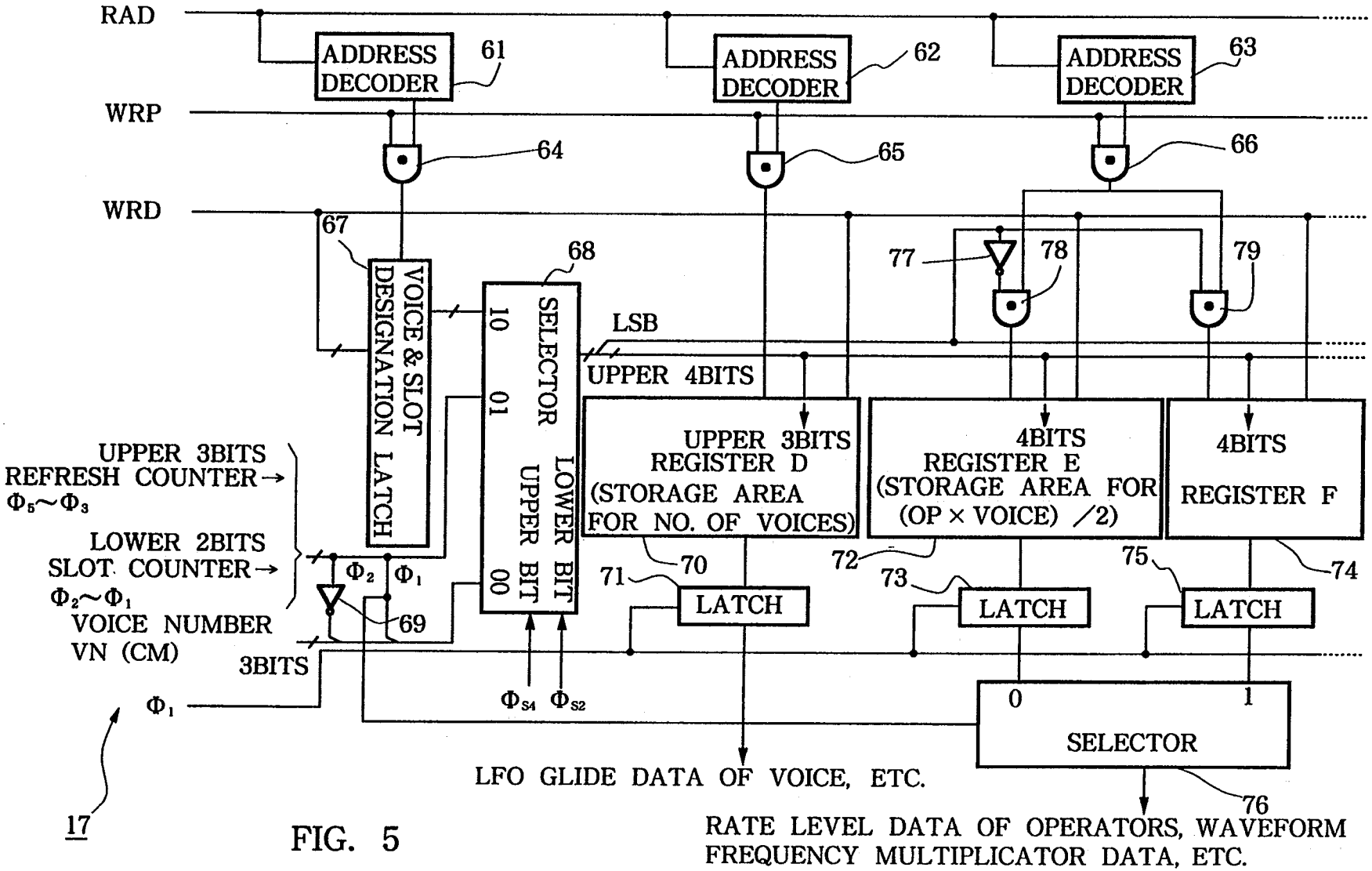
FIG. 5 is a block diagram showing an arrangement of a voice register section.

FIG. 2 is a detailed block diagram of the channel register section 16 of the electronic musical instrument of this embodiment. FIG. 3 is a detailed block diagram of the differential circuit 14 of this electronic musical instrument. FIG. 5 is a block diagram showing an arrangement of the voice register section 17.

The channel register section 16 will be described below with reference to FIG. 2. The channel register section 16 comprises address decoders 21, 22, and 23 for receiving and decoding the register address RAD. Reference numerals 24, 25, and 26 denote AND gates for calculating logic products between the decode signals from the address decoders 21, 22, and 23, and the write pulse signal WRP, respectively. The output signal from the AND gate 24 is inputted as a write instruction signal to a latch 27 for designating a channel and a slot.

The sound source of this embodiment is of a type for forming one voice by combining the four operators using various algorithms. Therefore, in order to supply parameter data to the operators, each channel has four timings ( slots ) for the four operators. A write position of parameter data in a register is specified by the channel and the slot.

The latch 27 stores channel & slot designation data, which represent a position where parameter data is to be stored. An output from the latch 27 has 6 bits. Since the number of channels is 16, data for specifying a channel requires 4 bits, and since four slots are provided for one channel, data for specifying a slot requires 2 bits. Of the 6-bit output of the latch 27, upper 4 bits are assigned as channel data, and lower 2 bits are assigned as slot data.

Figure 6:
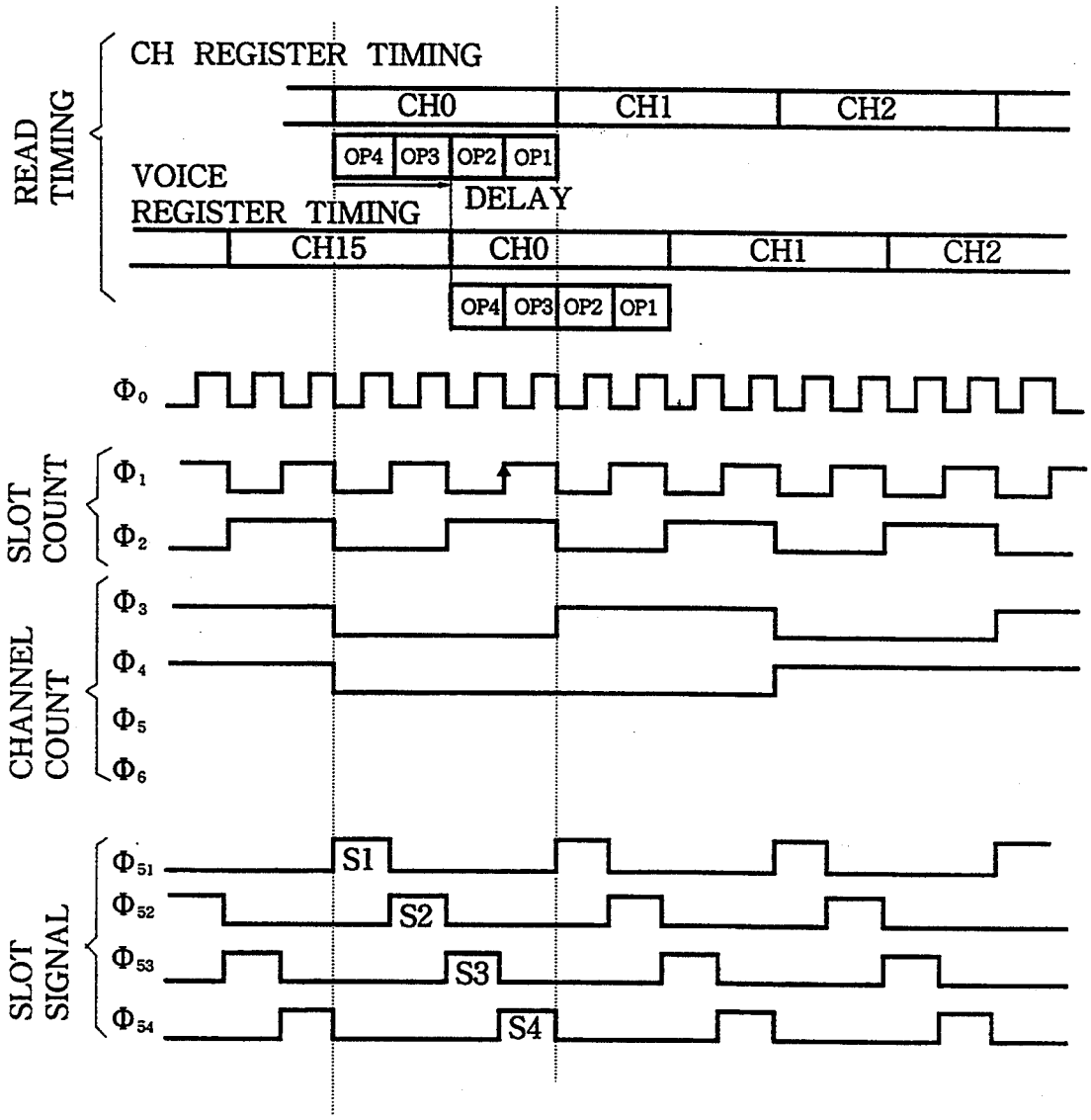
Fig. 6 is a timing chart of, e.g., a clock signal.

A selector 28 selects and outputs data from the latch 27 or data from the counters $\Phi_6$ to $\Phi_1$ in accordance with a timing of the slot signal $\Phi_{S4}$ (FIG. 6).

Reference numerals 29, 31, and 33 denote channel registers for storing parameter data. The channel registers include two types, i.e., a first type register for storing common parameter data to all the four operators in each channel, and a second type register for storing different parameters to the respective the operators of each channel.

The register 29 stores common parameters (e.g., F number data indicating a pitch, voice number data indicating a tone color of a corresponding channel, and the like) to all the operators in each channel. The register 29 has storage areas For storing parameter data For the number of channels (16 channels). The register 29 receives a write signal outputted from the AND gate 25. The selector 28 outputs 6-bit data (upper 4 bits specify a channel, and lower 2 bits specify a slot) stored in the latch 27. In this case, the register 29 receives only upper 4 bits of the 6-bit output data from the selector 28 since the register 29 is used for common parameter to each channel. The register 29 also receives parameter data as write data WRD.

The registers 31 and 33 are of a type for storing parameters (e.g., attack rate data and peak level data for each operator, and the like) to the respective operators in each channel. The registers 31 and 33 have a parallel structure, so that data at even addresses are written in the register 31, and data at odd addresses are written in the register 33. An inverter 36, and AND gates 37 and 38 realize the parallel structure of the registers 31 and 33. More specifically, the LSB of 6-bit data, outputted from the selector 28, for specifying a channel and a slot is inputted to the AND gate 37 via the inverter 36. The LSB is also inputted to the AND gate 38.

The AND gates 37 and 38 receive an output signal (write instruction signal) from the AND gate 26. The output signal from the AND gate 37 is inputted to the register 31 as a write signal, and the output signal from the AND gate 38 is inputted to the register 33 as a write signal. Therefore, when the LSB of the 6-bit data, outputted from the selector 28, for specifying a channel and a slot is "0", data is written in the register 31; when the LSB is "1", data is written in the register 33. The write data WRD is inputted to the registers 31 and 33.

Since the registers 31 and 33 have the parallel structure, only upper 5 bits can be used as address data for these registers 31 and 33. More specifically, upper 5 bits of an output from the selector 28 are inputted to the registers 31 and 33.

A latch 30 is arranged to read out parameter data from the register 29. Latches 32 and 34 are arranged to read out parameter data from the registers 31 and 33 respectively. The latches 30, 32, and 34 store parameter data read out from the registers 20, 31, and 33 on the basis of the counter signal $\Phi_1$, respectively. The register 29 outputs parameter data for each channel e.g., F number data or voice number data via the latch 30.

A selector 35 selects and outputs parameter data outputted from the registers 31 and 33 via the latches 32 and 34. The selector 35 outputs the storage value of the latch 32 or 34 in accordance with a value of the counter signal $\Phi_1$. In this case, the parameter data is attack rate data, peak level data, or the like.

The write pulse WRP is synchronous with the slot signal $\Phi_{S4}$, as will be described later. The selector 28 selects and outputs the channel & slot designation data in the latch 27 at a timing of the slot signal $\Phi_{S4}$. More specifically, in the block diagram of FIG. 2, write access of the registers 29, 31, and 33 is executed at a timing of the slot signal $\Phi_{S4}$.

Write operations to the registers in the channel register section 16 shown in FIG. 2 will be described in detail below.

Data (address data) for specifying a channel and a slot where data is written is stored in the latch 27. For this purpose, register address data for specifying the latch 27 is outputted as register address data RAD, and data for specifying a channel (upper 4 bits) and a slot (lower 2 bits) is outputted as write data WRD. A write pulse WRP synchronous with the slot signal $\Phi_{S4}$ is then outputted. Thus, the latch 27 stores the write data WRD, i.e., data for specifying a channel and a slot, at a timing of the write pulse WRP.

Parameter data to be written is then output as the write data WRD. Data for designating a register to be subjected to write access is outputted as the register address data RAD. The write pulse WRP synchronous with the slot signal $\Phi_{S4}$ is then outputted.

For example, when write access of the register 29 for storing parameter data for one channel is to be performed, the selector 28 outputs 6-bit address data, stored in the latch 27, for specifying a channel and a slot at a timing of the slot signal $\Phi_{S4}$. The register 29 receives a write instruction signal from the AND gate 25, and also receives upper 4 bits of the output from the selector 28, i.e., channel data. Therefore, the write data WRD, i.e., parameter data is written at the designated channel position.

When write access of the registers 31 and 33 is to be performed, data for specifying a channel and a slot is stored in the latch 27. Parameter data to be written is then outputted as write data WRD, and data for designating the register 31 or 33 to be subjected to write access is outputted as register address data RAP. The write pulse WRP synchronous with the slot signal $\Phi_{S4}$ is then outputted.

Thus, the selector 28 outputs 6-bit address data, stored in the latch 27, for specifying a channel and a slot at a timing of the slot signal $\Phi_{S4}$. When the LSB of the 6-bit address data outputted from the selector 28 is "0", a write instruction signal is inputted from the AND gate 37 to the register 31. On the other hand, when the LSB of the 6-bit address data outputted from the selector 28 is "1", a write instruction signal is inputted from the AND gate 38 to the register 33. The registers 31 and 33 receive upper 5 bits of the output from the selector 28. Thus, the write data WRD, i.e., parameter data is written at the designated storage position.

Generation of the write pulse WRP in the differential circuit 14 shown in FIG. 1 will be described below with reference to FIG. 3.

In FIG. 3, the write signal WR is inputted to a terminal S of a flip-flop 43, and is also inputted to an inverter 41. The output signal from the inverter 41 is inputted to an AND gate 42. The output signal from the AND gate 42 is inputted to a terminal R of the flip-flop 43. The output signal from the flip-flop 43 is inputted to a delay circuit 44, and the output signal from the delay circuit 44 is inputted to a latch 45. The latch 45 stores input data at a timing of the slot signal $\Phi_{S2}$. The output signal from the latch 45 is inputted to the AND gate 42, and is also inputted to a delay circuit 46. The output signal from the delay circuit 46 is inputted to a delay circuit 47 and an inverter 48. The output signals from the delay circuit 47 and the inverter 48 are inputted to an AND gate 49. The AND gate 49 generates a write pulse WRP as its output.

Figure 4:
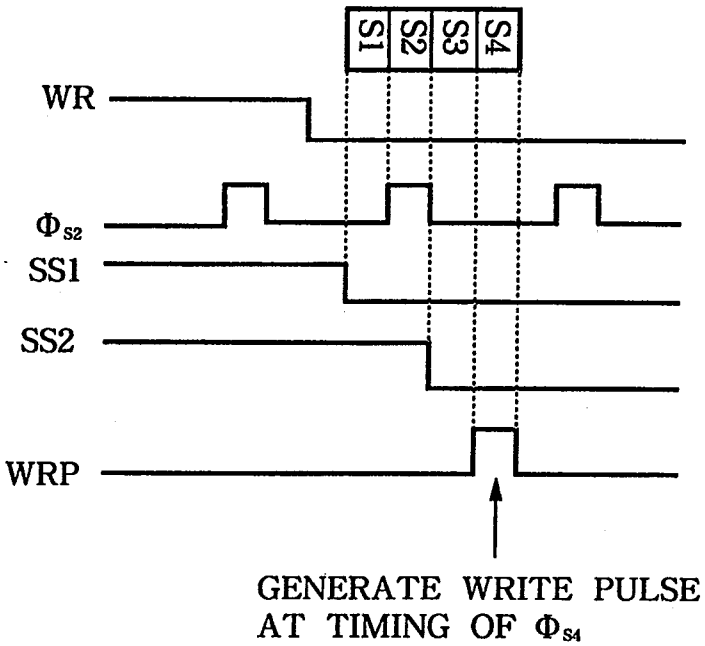
FIGS. 4(*a*) and 4(*b*) are timing charts of a WR signal in rising and falling states.
Figure 4:
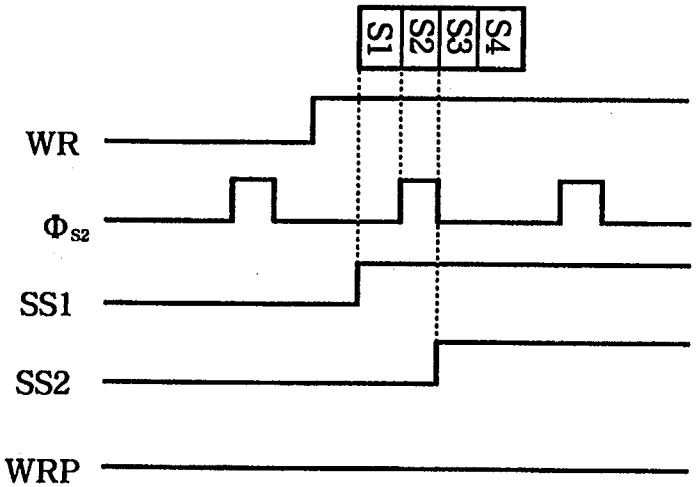

FIG. 4(*a*) is a timing chart when the write signal WR rises. As described above, the leading edge of the write signal WR corresponds to a timing at which the latches 12 and 13 latch a register address and data, respectively. In FIG. 4(*a*), SS1 designates a signal at a position corresponding to an output from the delay circuit 44, and an input to the latch 45. SS2 designates a signal at a position corresponding to an output from the latch 45 and an input to the delay circuit 46.

Referring to FIGS. 3 and 4(*a*), when the write signal WR goes to "1" level, the terminal S of the flip-flop 43 goes to "1" level, and the flip-flop 43 is set to be "1". The output signal "1" from the flip-flop 43 is inputted to the delay circuit 44. After a lapse of a predetermined delay time, the delay circuit 44 outputs a signal "1". Therefore, the signal SS1 goes to "1" level. The latch 45 stores "1" of the signal SS1 at a timing of the slot signal $\Phi_{S2}$. The latch 45 stably outputs stored "1" in response to the trailing edge of the slot signal $\Phi_{S2}$. Therefore, the signal SS2 goes to "1" level. The output signal "1" from the latch 45 is inputted to the AND gate 42. The AND gate 42 receives "0" obtained by inverting the write signal WR by the inverter 41. Therefore, the terminal R of the flip-flop 43 goes to "0" level, and the flip-flop 43 is not reset. The output signal "1" from the latch 45 is inputted to the delay circuit 46. After a lapse of a predetermined delay time, the signal "1" is inputted to the delay circuit 47 and the inverter 48. After an elapse of a predetermined delay time, the delay circuit 47 outputs a signal "1" to the AND gate 49. The inverter 48 inverts the input signal "1", and outputs a signal "0" to the AND gate 49. Therefore, the AND gate 49 outputs "0" as a write pulse WRP. As a result, when the write signal WP rises, no write pulse WRP is generated.

FIG. 4(*b*) is a timing chart when the write signal WR falls.

Referring to FIGS. 3 and 4(*b*), when the write signal WR is "1", both the signals SS1 and SS2 are "1". When the write signal WR goes to "0" level, the terminal S of the flip-flop 43 goes to "0" level. The write signal WR is inverted by the inverter 41, and a signal "1" is inputted to the AND gate 42. Since "1" of the signal SS2 is inputted to the AND gate 42, the AND gate 42 outputs a signal "1" to the terminal R of the flip-flop 43. Thus, the flip-flop 43 is reset to "0". The output signal "0" from the flip-flop 48 is inputted to the delay circuit 44. After a lapse of a predetermined delay time, the delay circuit 44 outputs a signal "0". Therefore, the signal SS1 goes to "0" level. The latch 45 stores "0" of the signal SS1 at a timing of the slot signal $\Phi_{S2}$. The latch 45 stably outputs the stored signal "0" in response to the trailing edge of the slot signal $\Phi_{S2}$. Therefore, the signal SS2 goes to "0" level. The output signal "0" from the latch 45 is inputted to the AND gate 42. Therefore, the terminal R of the flip-flop 43 is set to be "0", and the flip-flop 48 is no longer reset. The output signal "0" from the latch 45 is inputted to the delay circuit 46. After a lapse of a predetermined delay time, a signal "0" is inputted to the delay circuit 47 and the inverter 48. The delay circuit 47 keeps outputting "1" until a predetermined delay time elapses, and then outputs "0" to the AND gate 49. The inverter 48 inverts the input signal "0", and outputs "1" to the AND gate 49. Therefore, the AND gate 49 outputs a write pulse WRP which is set at "1" level for the same time interval as the delay time of the delay circuit 47. As a result, when the write signal WR falls, the write pulse WRP is generated. The delay times of the delay circuits 44, 46, and 47 are set to be predetermined values, so that the write pulse WRP can be generated in synchronism with the timing of the slot signal $\Phi_{S4}$.

In this manner, the differential circuit 14 generates the write pulse WRP at the timing of the slot signal $\Phi_{S4}$.

An operation for reading out parameter data from the channel register section 16 will be described below with reference to FIG. 2.

At slot timings other than the slot signal $\Phi_{S4}$, the selector 28 outputs the channel counter signals $\Phi_6$ to $\Phi_3$ (upper 4 bits), and the slot counter signals $\Phi_2$ and $\Phi_1$ (lower 2 bits). These signals serve as read address data, and data are read out from the registers 29, 31, and 33. Parameter data read out from the registers are read out from the latches 30, 32, and 34 at timings of the slot signals $\Phi_{S1}$ or $\Phi_{S3}$, and are stored in the latches 30, 32, and 34 at a timing of the leading edge of the slot count signal $\Phi_1$, The latches 30, 32, and 34 output the stored data as new data at a timing of the trailing edge of the slot counter signal $\Phi_1$. Therefore, parameter data are outputted from the latches 30, 32, and 34 while being delayed by two time slots from the input address.

More specifically, parameter data of a channel designated by the channel counter signals $\Phi_6$ to $\Phi_3$ can be read out from the register 29 at timings of the slot signals $\Phi_{S1}$, $\Phi_{S2}$, and $\Phi_3$, and the latch 30 is operated at the timings of the slot signals $\Phi_1$ or $\Phi_{S3}$. As a result, the parameter data are read out From the register 29 at timings of the slot signals $\Phi_{S1}$ or $\Phi_{S3}$, and are transferred to the musical tone generation block 18 shown in FIG. 1. Readout voice number data are transferred to the voice register section 17, and is used for reading out voice parameters.

Since parameter data in the register 29 are accessed by upper 4 bits of the output from the selector 28, sixteen parameter data for the respective channels are sequentially read out in accordance with the channel counter signals $\Phi_6$ to $\Phi_3$. That is, all the parameter data are read out.

In the registers 31 and 33, parameter data designated by the counter signals $\Phi_6$ to $\Phi_2$ can be read out at timings of the slot signals $\Phi_{S1}$, $\Phi_{S2}$, and $\Phi_3$. As described above, the parameter data are read out from the registers 31 and 33 at timings of the slot signals $\Phi_{S1}$ or $\Phi_{S3}$, are latched by the latches 32 and 34, and are then outputted from the latches 32 and 34 to be delayed by two time slots. After data are latched, they can be read out as needed. The selector 35 outputs parameter data in the register 31 when the LSB $\Phi_1$ is "0", and outputs parameter data in the register 33 when the LSB $\Phi_1$ is "1". The readout parameter data are transferred to the musical tone generation block 18 shown in FIG. 1.

Since the parameter data in the registers 31 and 33 are temporarily stored in the latches 32 and 34, and are then outputted via the selector 35, all the data can be read out.

The arrangement and operation of the voice register section 17 will be described below with reference to FIG. 5.

The voice register section 17 has substantially the same arrangement and operation as those of the channel register section 16 described above. Correspondences between the two sections and differences between the voice register section 17 and the channel register section 16 will be explained below. The two sections have the following correspondences:

(i) Address decoders 61, 62, and 63 in FIG. 5 correspond to the address decoders 21, 22, and 23 in FIG. 2, respectively.

(ii) AND gates 64, 65, 66, 78, and 79 in FIG. 5 correspond to the AND gates 24, 25, 26, 37, and 38 in FIG. 2, respectively.

(iii) Latches 67, 71, 73, and 75 in FIG. 5 correspond to the latches 27, 30, 32, and 34 in FIG. 2, respectively.

(iv) Selectors 68 and 76 in FIG. 5 correspond to the selectors 28 and 35 in FIG. 2, respectively.

(v) Registers 70, 72, and 74 in FIG. 5 correspond to the registers 29, 31, and 33, respectively.

The register 70 stores LFO control parameters, frequency glide parameters, and the like in units of voices, and the registers 72 and 74 store FM algorithm data, EG parameters of the respective operators, and the like.

The differences between the two register sections are that the number of voices is eight, although sixteen channels are set, and that the selector 68 and its peripheral circuit have different arrangements. Since the number of voices is eight, i.e., eight tone colors can be set, the latch 67 is a 5-bit latch. More specifically, an output from the latch 67 consists of upper 3 bits for specifying a tone color (voice), and lower 2 bits for specifying a slot. An output from the selector 68 also consists of 5 bits, and its LSB is connected to an inverter 77 and the AND gate 79. Upper 4 bits of the outputs from the selector 68 are inputted to the respective registers as address data. Note that the register 70 can be accessed by using upper 3 bits since it stores parameters in units for eight voices.

The selector 68 selects an output in accordance with a 2-bit input signal having the slot signal $\Phi_{S4}$ as an upper bit, and the slot signal $\Phi_{S2}$ as a lower bit. More specifically, when the values of the slot signals $\Phi_{S4}$ and $\Phi_{S2}$ are "10", the selector 68 outputs the value of the latch 67; when-they are "01", it outputs the values of the counter signals $\Phi_5$ to $\Phi_1$. When the values of the slot signals $\Phi_{S4}$ and $\Phi_{S2}$ are "00", the selector 68 outputs 5-bit data which includes voice number data VN (for each channel) transferred from the channel register section 16 as upper 3 bits, a bit obtained by inverting the slot counter signal $\Phi_2$ by an inverter 69 as the 2nd bit data from the LSB, and a bit of the slot counter signal $\Phi_1$ as the LSB. The reason why the value of the slot counter signal is inverted by the inverter 69 is as follows. That is, when the voice number data is outputted, since it is delayed by two time slots when viewed from the channel counter as described above, the value of the slot counter signal is inverted to correct this delay time. The delayed state is shown in the chart of read timings in FIG. 6.

As counters, the signals $\Phi_5$ to $\Phi_3$ (upper 3 bits) serve as a refresh counter, and the signals $\Phi_2$ and $\Phi_1$ (lower 2 bits) serve as a slot counter. The refresh counter is required since the registers 70, 72, and 74 comprise dynamic RAMs and must be refreshed.

Note that data stored in the registers are not limited to parameters of the FM sound source. For example, the present invention can be applied to parameters of a PCM or harmonic synthesis sound source, or parameters for a reverberation effect circuit. In the above embodiment, the registers comprise dynamic RAMs but may comprise static RAMs.

In the above embodiment, the number of channels is sixteen, and the number of voices is eight. However, the number of channels, and the number or combinations of voices are not limited to these. When the present invention is applied to generation of percussion tones or effector tones, only voice number data may be stored in the channel register.

The present invention can be applied not only to registers comprising RAMs but also to conventional shift registers.

As described above, according to the present invention, since registers in the sound source have a hierarchical structure, a tone color can be changed by rewriting a voice number in each channel register, therefore, voice (tone color) change in channels can be realized without direct rewriting voice parameter data every registers in channels to be changed. Furthermore, a load on a CPU can be reduced. In addition, a time required for switching a tone color can be shortened.

Since the registers in the sound source comprise RAMs, data can be written in an arbitrary channel, and high-speed write access can be attained. A read operation by the channel counter, and a write operation with a designated channel may be time-divisionally performed. Furthermore, since the RAMs are arranged in parallel with each other and are alternately used to read out data, parameters can be read out at a sufficient speed even when RAMs having a lower operation speed than a shift register are used.

What is claimed is:

1. A musical tone generation apparatus comprising:

a plurality of tone generation channels for generating musical tones on a time-division basis;

first parameter memory means for storing voice numbers, each of said voice numbers representing a tone color of each of said tone generation channels; and second parameter memory means for storing tone color control parameters for different tone colors, which parameters can be read out for each time division channel in correspondence with the respective voice number stored in said first parameter memory means;

wherein each of said tone generation channels receives the tone color control parameters read out from said second parameter memory means for the channel, and forms a musical tone according to the parameters.

2. An apparatus according to claim 1, wherein said first parameter memory means stores only said voice numbers.

3. An apparatus according to claim 1, wherein said first parameter memory means stores musical tone formation parameters in addition said voice numbers, and said tone generation channels form musical tones according to the musical tone formation parameters and the tone color control parameters read out from said second parameter memory means.

4. An apparatus according to claim 1, wherein said first and second parameter memory means comprise a random access memory.

5. A musical tone generation apparatus having time divisional tone generation channels, comprising:

address generating means for generating address data;

first and second parameter memory means for storing parameters for characterizing musical tones to be generated, wherein addresses of said first and second parameter memory means are designated by a first part of said address data;

selecting means for selecting one of said first and second parameter memory means in accordance with a second part of the address data, and for reading out designated parameters from a selected memory means; and musical tone forming means for receiving the parameter data outputted from said selecting means, and forming sample values constituting a musical tone according to the parameter data.

6. A musical tone generation apparatus according to claim 5 wherein said first part of said address data is upper bits of said address data and said second part of said address data is a lower bit of said address data.

* * * * *